US007586271B2

(12) United States Patent
Shuy

(10) Patent No.: US 7,586,271 B2
(45) Date of Patent: Sep. 8, 2009

(54) EFFICIENT LIGHTING

(75) Inventor: Geoffrey Wen-Tai Shuy, New Territories (HK)

(73) Assignee: Hong Kong Applied Science and Technology Research Institute Co. Ltd, Hong Kong (CN)

( * ) Notice: Subject to any disclaimer, the term of this patent is extended or adjusted under 35 U.S.C. 154(b) by 434 days.

(21) Appl. No.: 11/413,513

(22) Filed: Apr. 28, 2006

(65) Prior Publication Data

US 2007/0252805 A1 Nov. 1, 2007

(51) Int. Cl.
*H05B 37/02* (2006.01)

(52) U.S. Cl. ..... 315/291; 315/312; 315/360

(58) Field of Classification Search ..... 315/291, 315/312, 360, 246; 362/611–614, 600, 217, 362/219, 227, 251, 800; 345/102, 82, 83
See application file for complete search history.

(56) References Cited

U.S. PATENT DOCUMENTS

| | | | | |
|---|---|---|---|---|
| 4,388,558 | A | 6/1983 | Mizuno et al. | |
| 4,495,445 | A | 1/1985 | Turney | |
| 4,504,776 | A | 3/1985 | Haville | |
| 4,859,912 | A | 8/1989 | Lippmann et al. | |
| 5,175,528 | A | 12/1992 | Choi et al. | |
| 5,325,024 | A * | 6/1994 | Piejak et al. | 315/246 |
| 5,924,784 | A * | 7/1999 | Chliwnyj et al. | 362/234 |
| 6,469,453 | B2 * | 10/2002 | Tajika et al. | 315/199 |
| 6,690,146 | B2 | 2/2004 | Burgyan et al. | |
| 6,748,180 | B2 | 6/2004 | Feng | |
| 7,176,948 | B2 | 2/2007 | Lewis | |
| 2002/0047556 | A1 | 4/2002 | Tajika et al. | |
| 2002/0105373 | A1 | 8/2002 | Sudo | |
| 2005/0073495 | A1 * | 4/2005 | Harbers et al. | 345/102 |
| 2005/0219872 | A1 | 10/2005 | Lys | |
| 2006/0022617 | A1 | 2/2006 | Liao et al. | |
| 2006/0061305 | A1 * | 3/2006 | Ahn et al. | 315/312 |

FOREIGN PATENT DOCUMENTS

| | | |
|---|---|---|
| CN | 1370035 | 9/2002 |
| CN | 1459927 A | 12/2003 |
| CN | 1550850 A | 12/2004 |
| CN | 1589078 | 3/2005 |
| CN | 2696266 Y | 4/2005 |
| CN | 1658730 | 8/2005 |

(Continued)

OTHER PUBLICATIONS

Hecht, S. et al., "Energy, Quanta, and Vision," *The Journal of General Physiology*, Mar. 30, 1942, 819-840.

(Continued)

*Primary Examiner*—Douglas W Owens
*Assistant Examiner*—Ephrem Alemu
(74) *Attorney, Agent, or Firm*—Occhiuti Rohlicek & Tsao LLP

(57) ABSTRACT

A light source includes a plurality of lighting elements arranged to illuminate different regions of visual perception. Circuitry coupled to the light source is configured to supply power to a first subset of the lighting elements according to a first waveform and to a second subset of the lighting elements according to a second waveform out of phase with the first waveform.

32 Claims, 8 Drawing Sheets

FOREIGN PATENT DOCUMENTS

| | | | |
|---|---|---|---|
| CN | 1678157 | | 10/2005 |
| JP | 20020324685 | | 11/2002 |
| JP | 2005-128420 | A | 5/2005 |
| JP | 2006066358 | | 3/2006 |

OTHER PUBLICATIONS

Weichselgartner, E. and Sperling, G., "Continuous Measurement of Visible Persistence," *Journal of Experimental Psychology: Human Perception and Performance*, 1985, vol. 11, No. 6, 711-725.

Phillips Semiconductors, "Preliminary data: Data Sheet PCA9533 4-bit $I^2C$ LED dimmer," *Philips*, Dec. 12, 2002, 1-17.

Cohn, T. E., "Integration by the Human Eye: Implications for Warning Signal Design," *Working Paper*, 1993, 1-11, Retrieved on Sep. 15, 2005 from <http://www.uctc.net/papers/207.pdf>.

"Using a Function Generator to Create Pulse-Width Modulation (PWM) Waveforms," *Agilent Technologies*, Application Note 1466, Retrieved on Oct. 18, 2005 from <http://cp.literature.agilent.com/litweb/pdf/5988-9904En.pdf>.

Ports, D., "Switching and Pulse Width Modulation," *Tech Note*, May 15, 2004, 21M.735, 1-6, Retrieved on Oct. 18, 2005 from <http://ocw.mit.edu/NR/rdonlyres/Music-and-Theater-Arts/21M-735Spring2004/170174DB-1B9B-4033-B985-1570241CD7B4/0/drkp_tn9.pdf>.

* cited by examiner

| | 1 | 2 | 3 | 4 | 5 | 6 | 7 |
|---|---|---|---|---|---|---|---|
| A | √ | | | | | √ | √ |
| B | √ | √ | | | | | √ |
| C | √ | √ | √ | | | | |
| D | | √ | √ | √ | | | |
| E | | | √ | √ | √ | | |
| F | | | | √ | √ | √ | |
| G | | | | | √ | √ | √ |

FIG. 6

EFFICIENT LIGHTING

CROSS-REFERENCE TO RELATED APPLICATIONS

This application is related to U.S. application Ser. No. 11/414,455, titled "EFFICIENT LIGHTING," which is being filed concurrently with the present application, and which is also incorporated herein by reference.

BACKGROUND

The invention relates to efficient lighting, including design of energy-saving LED lighting.

Various approaches to powering a light source, such as a light emitting diode (LED), include applying a time varying signal (e.g., a voltage or current square wave) to power the source. In some light flashing circuits, the time varying signal is slow enough to generate a perceptible variation in light intensity, such as for flashing warning lights. Various studies of human visual perception suggest that for flashing light to be perceived as discrete flashes, the flash rate should be below the "flicker-fusion" frequency of approximately 20-30 Hz, above which a flashing light appears as a steady light. In some light dimming circuits, the duty cycle is reduced to provide a perception of a dimmed light source, and the frequency is fast enough (e.g., >100 Hz) to prevent perceptible flicker.

SUMMARY

In a general aspect, efficient lighting or energy-saving lighting, in particular for LED-based lighting, is based on a design approach that recognizes an interrelationship between two factors: the characteristics of the light source (e.g., an LED) and characteristics of human visual perception. Some types of light sources are able to provide fast transitions to a full brightness level, or to a complete dark level. For example, in LEDs, a quantum-well can light up to full brightness in less than 0.1 milliseconds, and can turn off in less than 0.1 milliseconds, and thus without circuit delay effects, some LEDs can be considered an immediate constant intensity light source when turned on, and can be considered immediately dark when turned off. Circuit delay can affect how quickly a light source can be turned on. For example, parasitic capacitance of an LED is one cause of circuit delay. The amount of parasitic capacitance of an LED can be on the order of above 100 micro-farad (e.g., on the order of 1 farad) for a package with a 1 millimeter square LED chip. The associated circuit delay can be taken into account when selecting what kind of waveform to use for driving the LED circuit.

Human visual perception is associated with characteristic response times. For example, in human visual perception, the human visual system can retain images (i.e., retain the perception of intensity of past brightness) for as long as 30-50 milliseconds ("retention time"), and also has a short response time to perceive the full brightness, e.g., about 1-3 milliseconds ("response time"). The retention time is on the order of the inverse of the flicker-fusion frequency. A design approach for efficient or energy-saving lighting takes advantage of the fast response of LEDs and the large ratio of retention time to response time in the human visual system.

In one aspect, in general, the invention features an apparatus, comprising: a light source including a plurality of lighting elements arranged to illuminate different regions of visual perception; and circuitry coupled to the light source configured to supply power to a first subset of the lighting elements according to a first waveform and to a second subset of the lighting elements according to a second waveform out of phase with the first waveform.

In another aspect, in general, the invention features a method for efficient lighting, comprising: supplying power to a first lighting element according to a first waveform to control the intensity of light emitted from the first lighting element to illuminate a first region of visual perception; and supplying power to a second lighting element according to a second waveform out of phase with the first waveform to control the intensity of light emitted from the second lighting element to illuminate a second region of visual perception.

Aspects can include one or more of the following features.

The lighting elements comprise light emitting diodes.

The light emitting diodes comprise a two dimensional array of light emitting diodes.

The circuitry supplies power to a first set of rows of the array with the first waveform and to a second set of rows of the array with the second waveform.

The light emitting diodes are configured and arranged to provide backlight for a liquid crystal display.

The first waveform comprises an alternating current waveform applied to the first subset from a pair of terminals in a first polarity, and the second waveform comprises the alternating current waveform applied to the second subset from the terminals in an opposite polarity from the first polarity.

The alternating current waveform comprises a sinusoidal waveform.

The first waveform and the second waveform comprise rectangular pulses.

The first and second waveforms comprise periodic waveforms.

The periods of the first and second waveforms are shorter than the inverse of a flicker-fusion frequency.

The periods of the first and second waveforms are between about 3 ms and 50 ms.

The periods of the first and second waveforms are between about 20 ms and 30 ms.

Aspects can have one or more of the following advantages.

With an LED that is driven to full brightness in less the response time of the human visual system, energy savings can be achieved by using a duty cycle that has an on time that exceeds the response time and an off time that is less than the retention time of the human visual system.

One factor associated with powering a light source is circuit delay between a time a signal (e.g., a voltage step) is applied and the time the light source (e.g., a quantum well of an LED) receives the full power provided by the signal. In some circuits, the frequency of the signal used to power an LED is high, such that, in the presence of circuit delay, the LED on time is shorter than the circuit delay time plus the response time. In these cases, the circuit provides a dimming effect. By selecting the frequency and duty cycle such that the LED on time is at least as long as the circuit delay time plus the response time and the LED off time is shorter than the retention time, a circuit can provide the perceived brightness of an LED that is always on with lower energy expended in a given time period. In some cases, a circuit controls a group of lighting elements arranged so that each element illuminates a different region of visual perception. The regions correspond to different parts of a lighting area such as a room. The lighting elements (e.g., LEDs) are selectively illuminated to scan over the lighting area in a "cycle time." To save energy, the signals powering the LEDs fulfill at least the following criteria: (1) the cycle time is shorter than the retention time; (2) the LED on time of each LED is longer than the circuit delay time plus the response time. Other relevant criteria, described in more detail below, enable a power supply circuit to reduce the twinkling of the LEDs to a level that human visual system cannot detect.

An approach in which the LED on time is shorter than the circuit delay time plus the response time may expend less energy in a given time period relative to an LED that is always on, but does not save energy while providing the same perceived brightness as an LED that is always on. Approaches described herein can achieve energy efficient lighting with at least the same perceived brightness as compared to DC driven light source.

Other features and advantages of the invention are apparent from the following description, and from the claims.

DESCRIPTION OF DRAWINGS

FIG. 6 is a table showing a sequence in which subsets of lighting elements are powered.

DESCRIPTION

Figure 1:
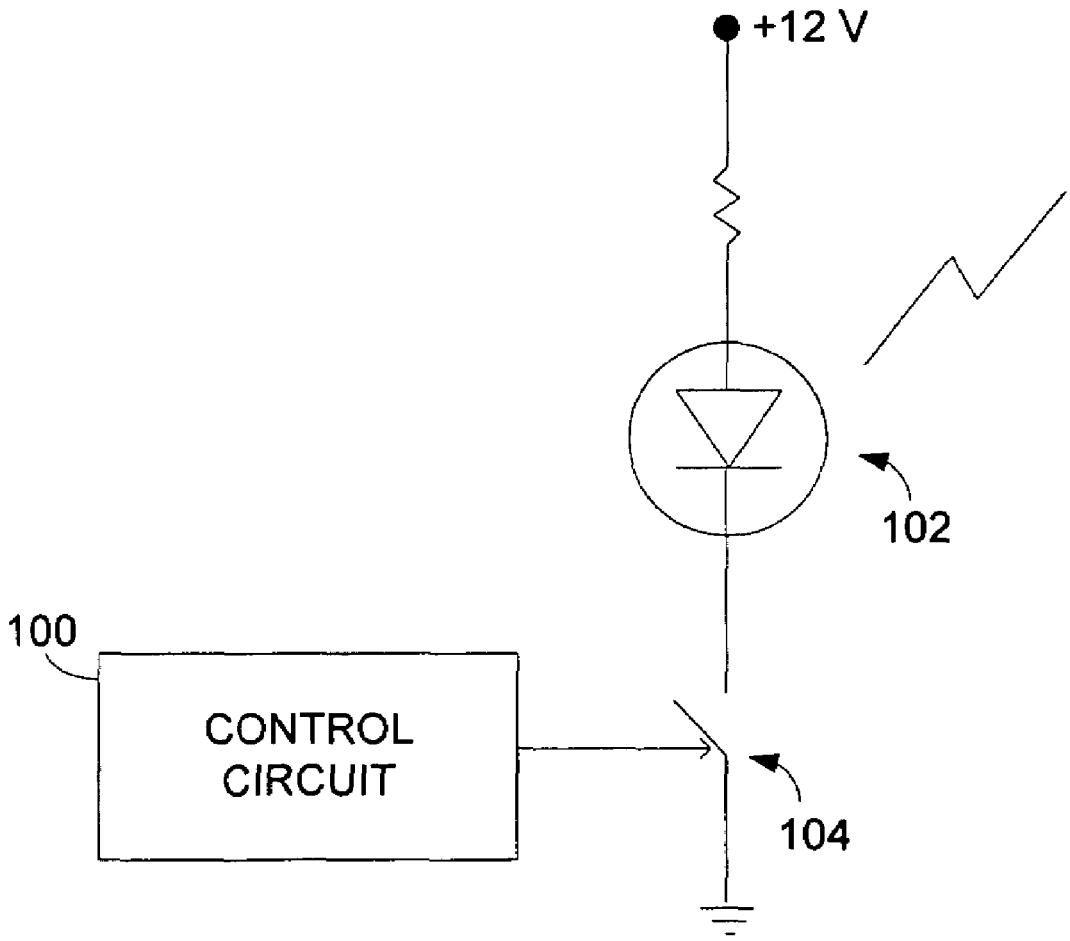
FIG. 1 is a schematic diagram of a control circuit for powering an LED.
Figure 2A:
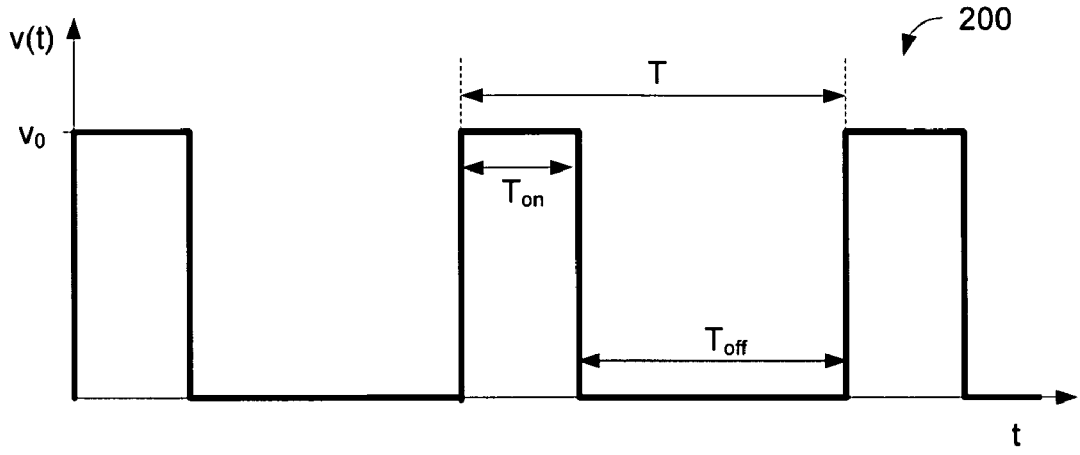
FIGS. 2A and 2B are plots of electric signal waveforms.
Figure 2B:
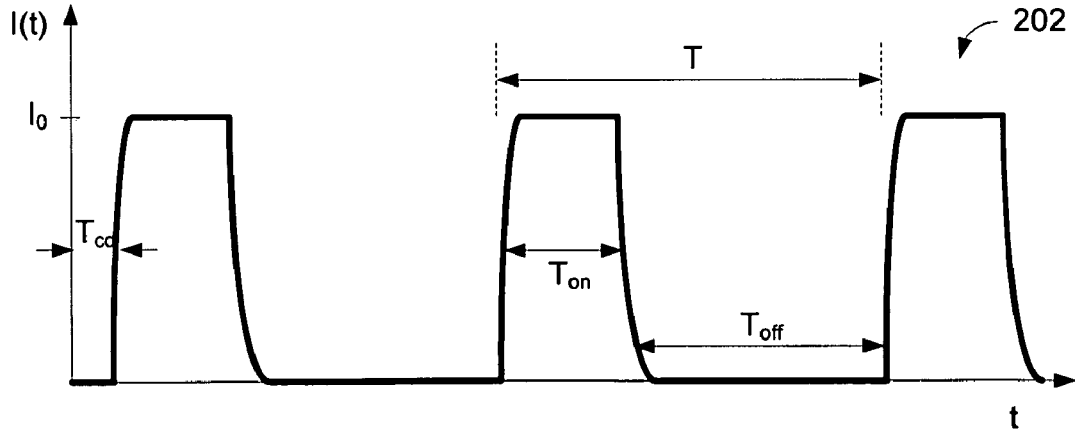

Referring to FIGS. 1 and 2A, a control circuit 100 controls the supply of power to an LED 102 by applying a control waveform 200, a voltage v(t), to input terminals of a switch 104 (e.g., a transistor). When the control waveform 200 closes the switch, current flows to power the LED 102. FIG. 2B shows a resulting intensity waveform 202 that represents intensity I(t) of light emitted from the LED 102. The control waveform 200 is a square-wave with a period T, and a duty cycle D≈25%. The resulting intensity waveform 202 has an "on time" of $T_{on}$≈TD, during which the LED is emitting light, and an "off time" of $T_{off}$≈T(1−D), during which the LED is not emitting light. The on and off times of the intensity waveform are approximately determined by the duty cycle of the control waveform, but the times may deviate somewhat since the characteristics of the intensity waveform 202 are not necessarily the same as those of the control waveform 200 due to circuit effects and parasitic capacitance and/or inductance of the LED. For example, the waveform 202 is delayed with respect to the waveform 200 by a circuit delay time $T_{cd}$, and the shape of the intensity waveform 202 is not an exact square-wave.

The control circuit 100 can apply other shapes of control waveforms to obtain an intensity waveform that has a shape closer to that of a square-wave. For example, the control circuit 100 takes into account the current-voltage (I-V) characteristic of the light source. In this example, the LED has an I-V characteristic of a diode with negligible current when an applied voltage is below a threshold voltage $V_c$. When the applied voltage (controlled by the control waveform 200) is above $V_c$, the current through the LED increases approximately exponentially.

In one approach, the control circuit and control waveform are configured such that the voltage across the LED during the "off time" is closer to a value of $V_c$ than to a value of zero. The circuit delay (e.g., due to parasitic capacitance) between an "off" voltage just below $V_c$ and an operating "on" voltage of $V_o$ at full light emission, can be reduced compared to a circuit delay between an "off" voltage of zero and on "on" voltage of $V_o$. Other, approaches can be used to produce a substantially rectangular intensity waveform, including the use of waveform shaping circuitry, for example, to generate an intensity waveform that has short rise and fall times and short delay between application of a control waveform and the resulting intensity waveform.

A procedure for configuring a control circuit to provide power to a light source, such as an LED, includes selecting on and off times of the waveform representing power supplied to the light source according to characteristics of human visual perception. For example, without intending to be bound by theory, the following description of a light detector provides an example of a model of human visual perception that can be used for selection of waveform characteristics.

Figure 3:
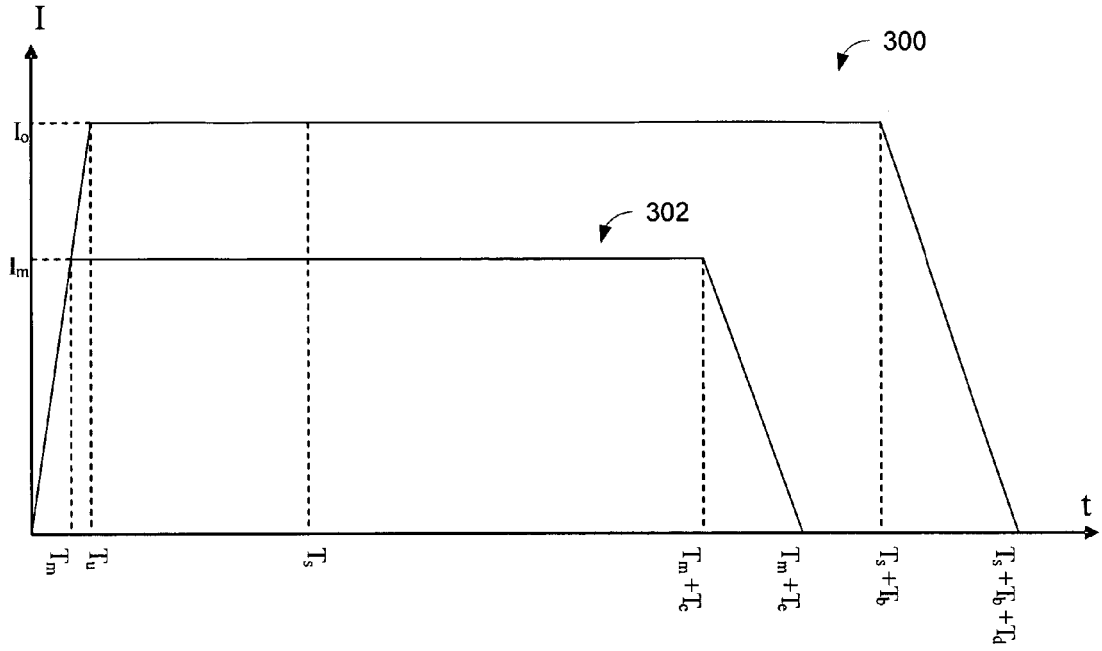
FIG. 3 is a plot of a detector intensity reading.

FIG. 3 shows a plot 300 of an intensity reading of the detector modeling human visual perception. In this model, the detector receives a constant intensity $I_0$ light flux via the opening of a very fast shutter (which takes no significant time) at time t=0. Before the shutter opens the intensity reading of the detector is I=0. After the shutter opens, as time goes on, the reading of the light flux will increase (approximately linearly) and stabilize at $t=T_u$ to a reading of $I=I_0$. The time $T_u$ represents the visual response time (or time to saturation). When the shutter is closed at $t=T_s>T_u$, the detector reading remains $I=I_0$ for a time $T_b$ and starts to decrease (approximately linearly) at $t=T_s+T_b$. The detector reads I=0 after a time period $T_d$ beyond $t=T_s+T_b$. The time $T_b$ represents the visual retention time (or persistence time), and $T_d$ is the decay time.

Under this model, as shown in plot 302, if the shutter is open at t=0 and closed at $t=T_m<T_u$, the detector reading will not rise from I=0 to $I=I_0$ by $t=T_m$, since the shutter was open for less than the response time $T_u$. Instead, the detector will read $I=I_m<I_0$ at $t=T_m$, and will maintain this reading until $t=T_m+T_c$, where $T_c$ is not greater than $T_b$. The detector will read I=0 at $t=T_m+T_c+T_e$, where $T_e$ is not greater than $T_d$.

The following two cases demonstrate the effect on the detector of repeatedly opening and closing the shutter to represent a light source controlled according to a periodic waveform, for example.

In a first case, if the shutter is repeatedly opened (for a time $T_m<T_u$) and closed (for a time $T_x<T_c$) resulting in an open/close shutter cycle with a period $T_p=T_m+T_x$ the detector will eventually achieve a steady state intensity reading of $I<I_0$. This case corresponds to a model for a lower perceived intensity (or "dimming") of a light source. In this case, the "off time" $T_x$ is shorter than the retention time $T_c$ to provide a constant perceived intensity without flicker.

In a second case, if the shutter is repeatedly opened (for a time $T_s>T_u$) and closed (for a time $T_y<T_b$) resulting in an open/close shutter cycle with a period $T_p=T_m+T_y$ the detector will eventually achieve a steady state intensity reading of $I=I_0$. This case corresponds to a model for achieving a full perceived intensity of a light source, even though the light source has been turned on and off periodically. In this case, in order to ensure the full intensity is perceived, the light source on/off time intervals (modeled by the shutter open/close times) are selected such that: (1) the "on time" $T_s$ longer than the response time $T_u$, and (2) the "off time" $T_y$ is shorter than the retention time (to provide a constant perceived intensity without flicker).

Although an LED can be turned on or off with a short switching time ($T_{LED}$) less than 1 ms (e.g., approximately 0.1 ms), the circuit delay ($T_{cd}$) between the application of an electrical signal to a circuit powering the LED and the full light emission from the LED can be greater than 1 ms, and depending on the circuit and parasitic capacitance and/or inductance of the LED, can be as long as 3 ms, 5 ms, 10 ms, or even longer.

If the circuit delay $T_{cd}$ is longer than or comparable to the "on time" of the waveform powering the LED, then the voltage across LED may not reach a full operating voltage, causing the LED to have a lower brightness than it has from the full operating voltage. In some cases, the light flux (and resulting brightness) from the LED is a strong function of the voltage across the LED beyond a threshold voltage (e.g., 3.3 volts).

If the LED switching time $T_{LED}$ is 1 ms, and the circuit delay $T_{cd}$ is in the range of 3 to 5 ms, it would take $T_{LED}+T_{cd}=4$ to 6 ms for the LED to reach full intensity after the circuit switches the LED on. If the modeled human visual response time $T_u$ is in the range of 1 to 3 ms, it would take $T_{LED}+T_{cd}+T_u=5$ to 9 ms for the full brightness to be perceived. In such a case, the "on time" of the waveform powering the LED at a given voltage level should be at least 9 ms to ensure the perceived brightness of the LED is substantially the same as the perceived brightness of an LED continuously powered at the same voltage level. A shorter "on time" could cause a lower perceived brightness by (1) not allowing enough time for the voltage across LED from reaching a full operating voltage, and/or (2) not allowing enough time for human visual response to perceive the full brightness.

For a given set of on and off times for a waveform powering an LED, another technique for increasing the perceived brightness level includes increase the high voltage level of the waveform. For example, an increased voltage helps to overcome the effect of parasitic inductance and capacitance to achieve an operating voltage across LED in a shorter time. An increased voltage also helps to achieve a higher steady state perceived brightness. However, increasing the voltage level reduces the energy savings that are achieved, and may even lead to higher energy consumption.

Figure 4A:
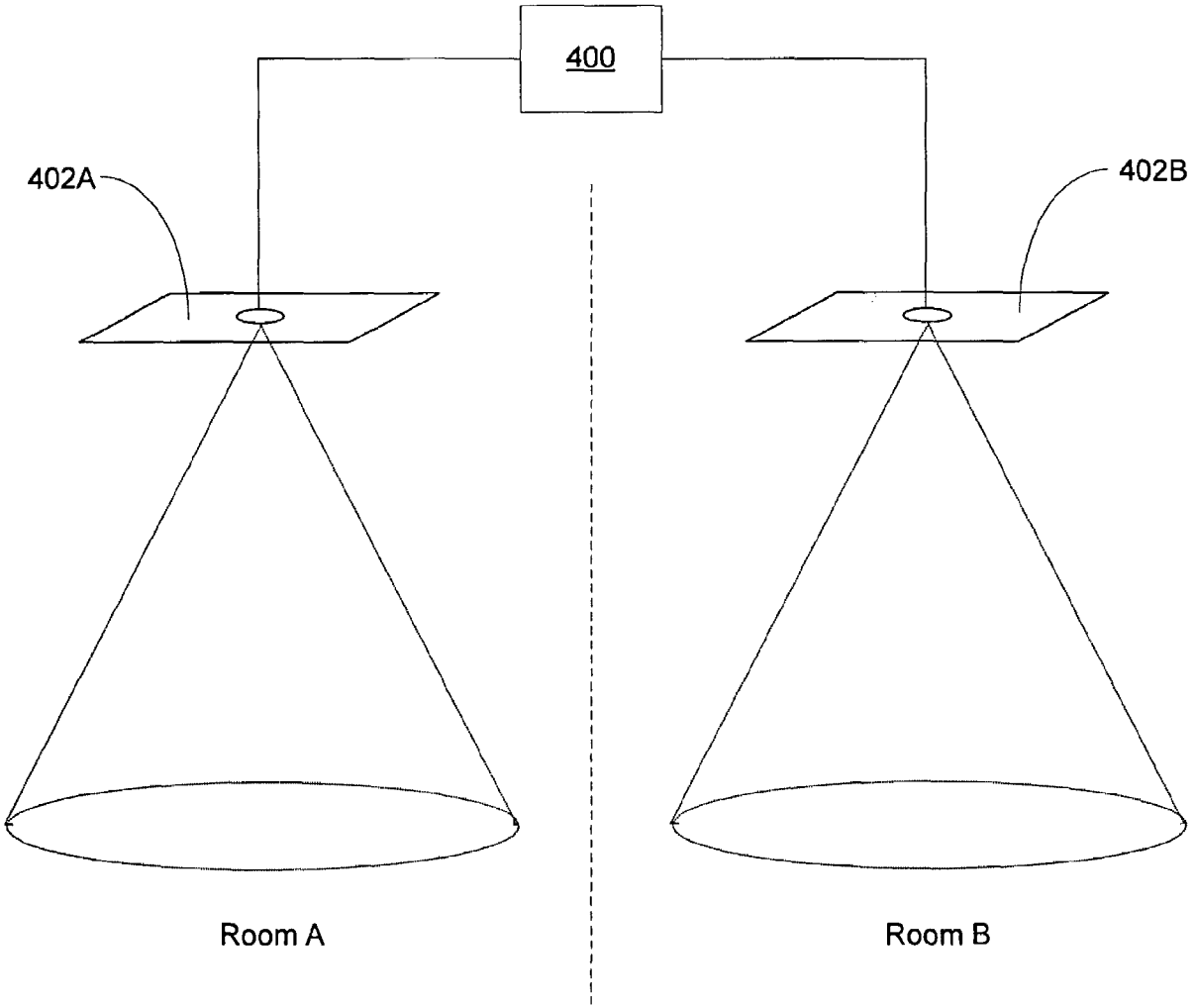
FIGS. 4A and 5 are schematic diagrams of lighting systems including multiple lighting elements.

Power savings can also be achieved in a distributed light source with multiple lighting elements arranged to illuminate different regions of visual perception. Referring to FIG. 4A, a control circuit 400 supplies power to a first lighting element 402A illuminating a first room (Room A), and to a second lighting element 402B illuminating a second room (Room B). For example, a lighting element can include an LED or array of multiple interconnected LEDs. The control circuit 400 supplies power to the first lighting element 402A according to a first waveform and to the second lighting element 402B according to a second waveform out of phase with the first waveform.

Figure 4B:
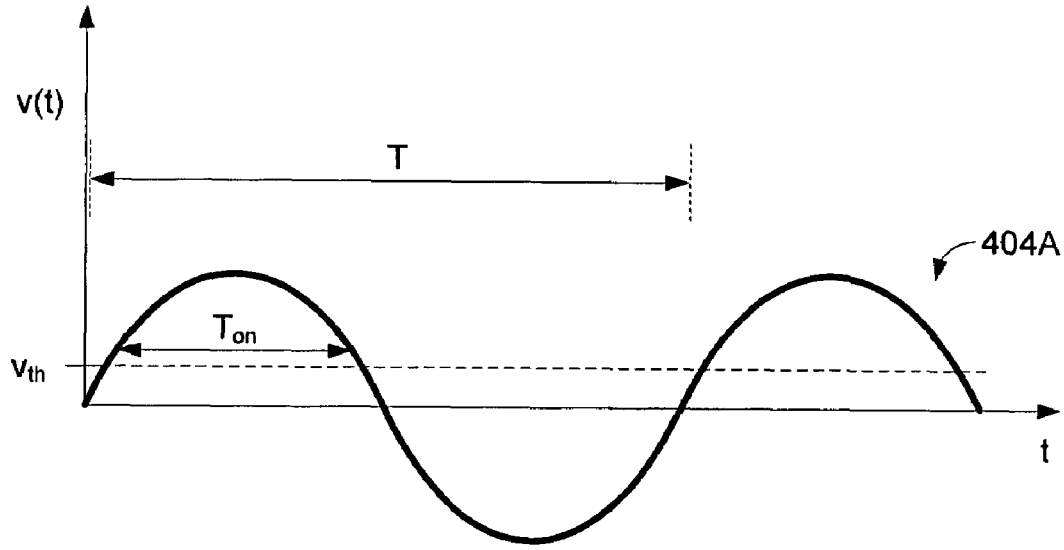
FIGS. 4B and 4C are plots of electrical signal waveforms.
Figure 4C:
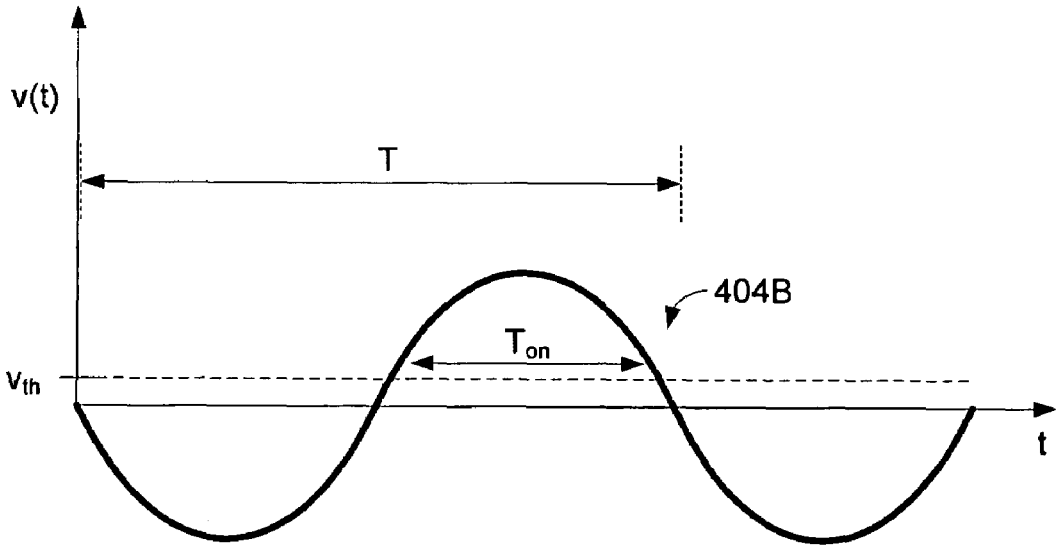

For example, the control circuit 400 drives the first lighting element 402A from a pair of electrical terminals with a sine wave 404A (FIG. 4B) alternating between +12 volts and −12 volts derived from a 60 Hz power line voltage source. The control circuit 400 drives the second lighting element 402B with a sine wave 404B (FIG. 4C) from the same terminals with opposite polarity. During one lighting cycle T in Room A, the first lighting element 402A emits light for a time $T_{on}$, corresponding to the sine wave 404A being above a threshold $V_{th}$. During one lighting cycle T in Room B, the second lighting element 402B emits light for a time $T_{on}$, corresponding to the sine wave 404B being above the threshold $V_{th}$. Since one lighting cycle is one period of the 60 Hz sine wave (about 16.7 ms), the off time of the lighting elements is less than the retention time of the human visual system (about 30-50 ms). The on time $T_{on}$, of the lighting elements depends on the threshold $V_{th}$, but is approximately 5-8 ms when the circuit delay is kept small (e.g., less than a few milliseconds), which is greater than the response time of the human visual system (about 1-3 ms).

This exemplary "AC lighting" approach can save energy compared to a "DC lighting" approach in which a 60 Hz power line voltage source is converted to a constant DC voltage to power the lighting elements. The AC lighting approach can provide comparable perceived brightness with lower consumed power since the power supply does not need to convert from AC to DC. The power savings is higher compared to power supplies that generate large current (for example>3 A) since large current conversion efficiency is lower (e.g., typically less than 60% efficiency).

The different regions of visual perception can correspond to different spaces such as the rooms in the previous example, or upper and lower cabinets of a show-case, for example, or can correspond to different overlapping regions of visual perception.

Figure 5:
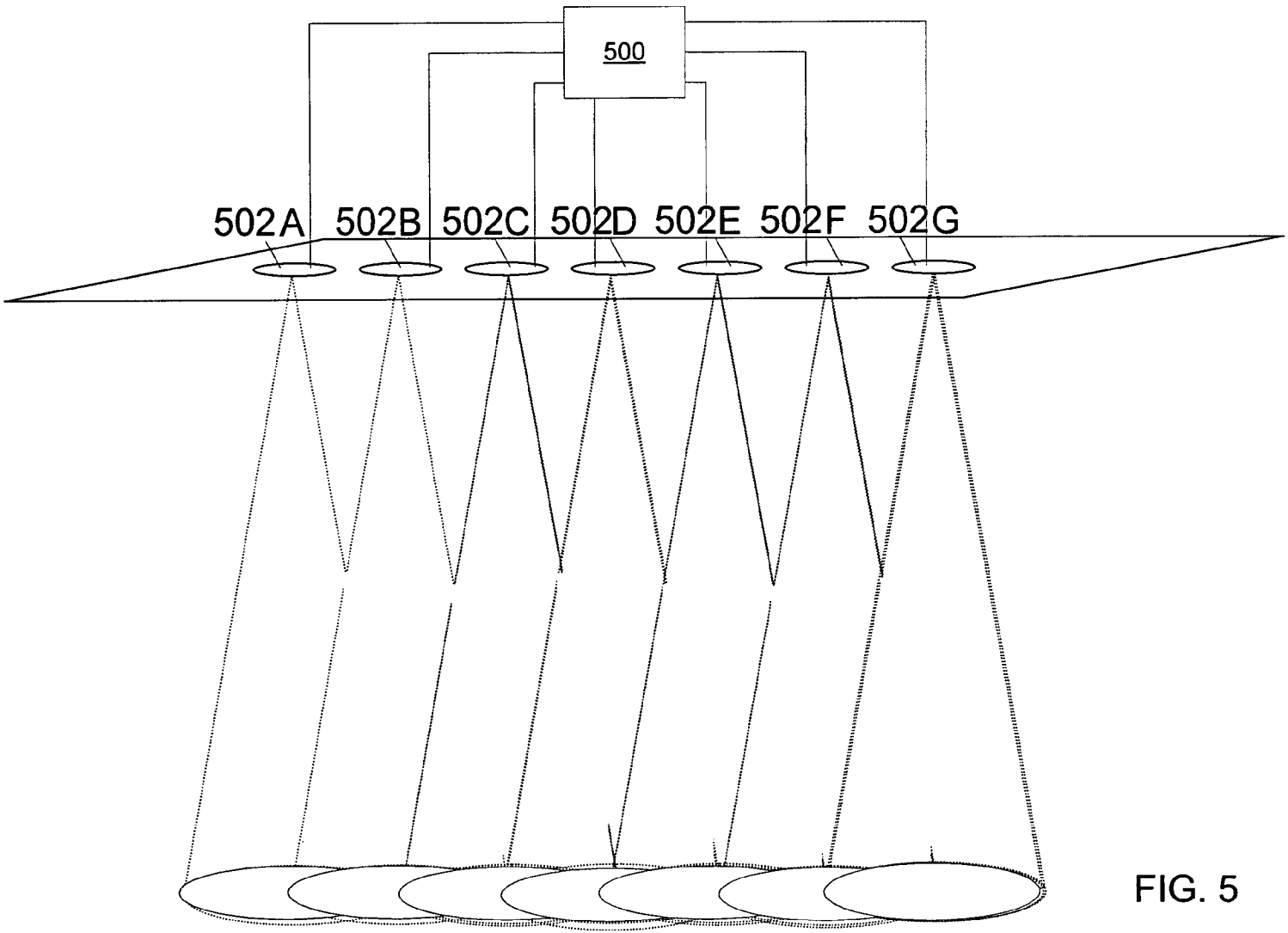

Referring to FIG. 5, a control circuit 500 supplies power to a group of lighting elements 502A-502G arranged to illuminate different overlapping regions of visual perception (or "lighting zones") within an illumination area (e.g., a room). The control circuit 500 powers subsets of 3 lighting elements at a time in a sequence shown in FIG. 6. The rows A-G correspond to lighting elements 502A-502G, and the columns 1-7 correspond to seven time slots in a repeated sequence for powering the lighting elements. The control circuit 500 illuminates lighting elements 502A-502C during the first time slot, lighting elements 502B-502D during the second time slot, and so on as shown in FIG. 6. The control circuit 500 scans over the illumination area over a time period $T_{sc}$ that is less than the retention time of the human visual system. During each time slot, the control circuit 500 powers on the corresponding subset of lighting elements for a time longer than the response time of the human visual system. By selecting the phases of the waveforms that power the subsets of lighting elements according to the table in FIG. 6, the power consumption level is essentially constant in time and only three lighting elements need to be powered at any given time.

Another aspect of arranging lighting elements to efficiently illuminate different regions of visual perception is controlling the beam shapes and resulting footprint of the respective illuminated areas. At a given distance from a lighting element, the intensity of light at the illuminated area is higher when the beam divergence (and the footprint) is smaller.

Figure 7:
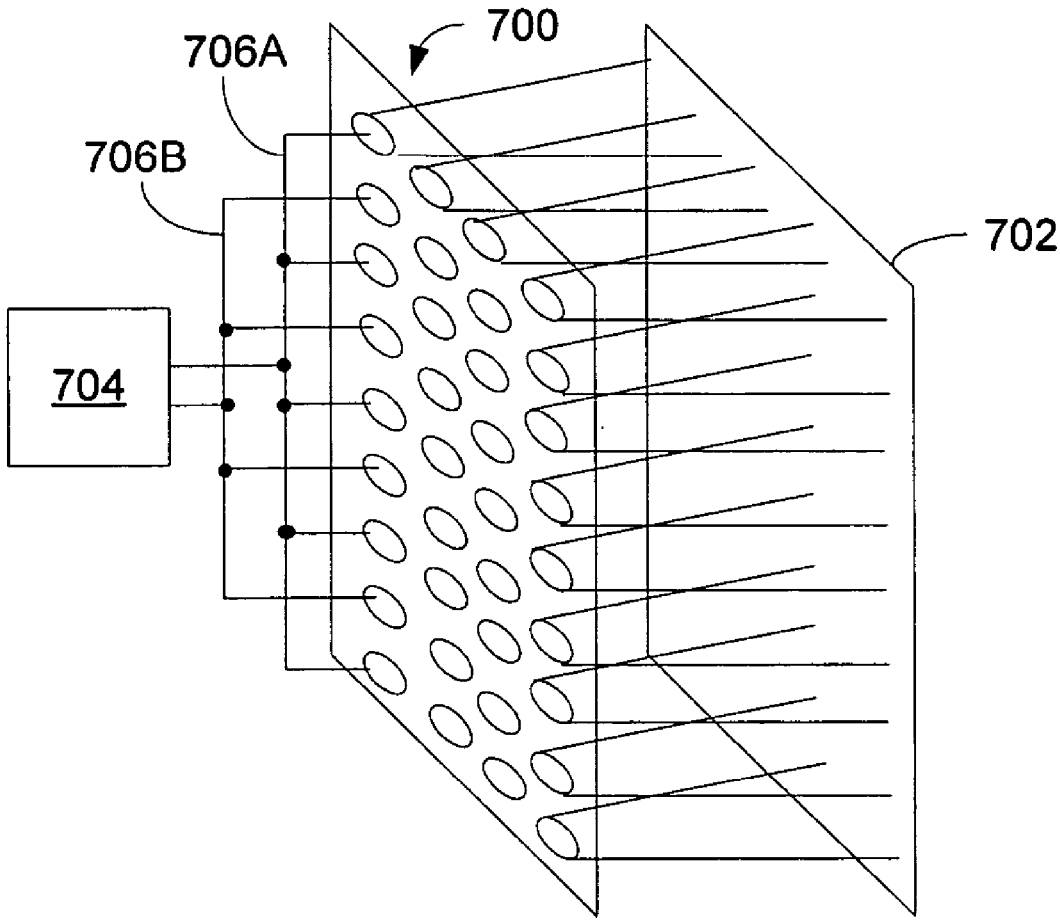
FIG. 7 is a schematic diagram of an array of LEDs backlighting an LCD panel.

For example, FIG. 7 shows a two-dimensional array of LEDs 700 to provide backlight for a liquid crystal display (LCD) panel 702. A small lighting footprint can be achieved in at least two ways: (1) the LEDs can be placed a short distance from the panel (e.g., shorter than 5 cm), and (2) the angle of illumination from the LEDs can be made small (e.g., by choice of the numerical aperture of an optical enclosure for the LED). If the illumination footprint of each LED at the panel 700 is reduced by a factor of $\alpha$ (in diameter), the number of LEDs used to illuminate the panel can be increased by approximately a factor of $1/\alpha^2$ to cover the same area with a brighter backlight. By powering subsets of LEDs with waveforms that are out of phase, as described above, the amount of power used to backlight the panel can be reduced compared to a panel backlit by fewer continuously powered LEDs. For example, a control circuit 704 powers a first set of rows 706A according to a first waveform, and a second set of rows 706B according to a second waveform out of phase with the first waveform.

Other embodiments are within the scope of the following claims.

What is claimed is:

1. An apparatus comprising:

a light source including a plurality of lighting elements arranged to illuminate separated regions, each region being illuminated by a corresponding disjoint subset of the plurality of lighting elements; and circuitry coupled to the light source configured to supply power to a first of the disjoint subsets of the lighting elements according to a first waveform and to a second of the disjoint subsets of the lighting elements according to a second waveform out of phase with the first waveform.

2. The apparatus of claim 1, wherein the lighting elements comprise light emitting diodes.

3. The apparatus of claim 2, wherein the light emitting diodes comprise a two dimensional array of light emitting diodes.

4. The apparatus of claim 3, wherein the circuitry supplies power to a first set of rows of the array with the first waveform and to a second set of rows of the array with the second waveform.

5. The apparatus of claim 2, wherein the light emitting diodes are configured and arranged to provide backlight for a liquid crystal display.

6. The apparatus of claim 1, wherein the first waveform comprises an alternating current waveform applied to the first subset from a pair of terminals in a first polarity, and the second waveform comprises the alternating current waveform applied to the second subset from the terminals in an opposite polarity from the first polarity.

7. The apparatus of claim 6, wherein the alternating current waveform comprises a sinusoidal waveform.

8. The apparatus of claim 1, wherein the first waveform and the second waveform comprise rectangular pulses.

9. The apparatus of claim 1, wherein the first and second waveforms comprise periodic waveforms.

10. The apparatus of claim 9, wherein the periods of the first and second waveforms are shorter than the inverse of a flicker-fusion frequency.

11. The apparatus of claim 9, wherein the periods of the first and second waveforms are between about 3 ms and 50 ms.

12. The apparatus of claim 11, wherein the periods of the first and second waveforms are between about 20 ms and 30 ms.

13. A method for lighting comprising:

supplying power to a first set of lighting elements according to a first waveform to control the intensity of light emitted from the first set of lighting elements to illuminate a first region; and supplying power to a second set of lighting elements according to a second waveform out of phase with the first waveform to control the intensity of light emitted from the second set of lighting elements to illuminate a second region, the second region being separated from the first region; and achieving a perceived intensity of illumination over the first and second regions with power less than required to achieve the perceived intensity using a constant waveform.

14. The method of claim 13, wherein the first and second waveforms comprise periodic waveforms.

15. The method of claim 14, wherein the periods of the first and second waveforms are shorter than the inverse of a flicker-fusion frequency.

16. The method of claim 14, wherein the periods of the first and second waveforms are between about 3 ms and 50 ms.

17. The method of claim 16, wherein the periods of the first and second waveforms are between about 20 ms and 30 ms.

18. The method of claim 13, wherein the first waveform comprises an alternating current waveform applied to the first subset from a pair of terminals in a first polarity, and the second waveform comprises the alternating current waveform applied to the second subset from the terminals in an opposite polarity from the first polarity.

19. The method of claim 18, wherein the alternating current waveform comprises a sinusoidal waveform.

20. The method of claim 13, wherein the first waveform and the second waveform comprise rectangular pulses.

21. The apparatus of claim 1, wherein each of the first and second waveforms comprises a periodic waveform having a level at least 50% of a threshold level required to illuminate the lighting elements throughout each period.

22. A method for lighting an area comprising:

illuminating the area using a plurality of lighting elements disposed over the area, including scanning illumination over the area by successively driving subsets of the lighting elements;

wherein each of the lighting elements is driven according to a respective one of a set of sequential phases of a signal; and wherein the signal has a frequency higher than a flicker-fusion threshold for maintaining a steady visual perception of the illumination and has, during each period, a first time interval associated with activation of the lighting elements and a second time interval associated with non-activation of the lighting elements, the first time interval being longer than a response threshold for perceiving full brightness of the lighting elements.

23. The method of claim 22, wherein at least some regions of the area are substantially disjoint regions of visual perception.

24. The method of claim 22, wherein each of the subset of the light elements corresponds to a substantially constant load.

25. The method of claim 22, wherein the second time interval has a different duration from the first time interval.

26. A lighting system comprising:

a light source including a plurality of lighting elements disposed over an area for illuminating overlapping regions of the area; and a controller coupled to the light source to control a signal for successively driving subsets of the lighting elements to scan illumination over the area;

wherein the signal includes a set of sequential phases each associated with a respective one of the lighting elements; and wherein the signal has a frequency higher than a flicker-fusion threshold for maintaining a steady visual perception of the illumination and has, during each period, a first time interval associated with activation of the lighting elements and a second time interval associated with non-activation of the lighting elements, the first time interval being longer than a response threshold for perceiving full brightness of the lighting elements.

27. The efficient lighting system of claim 26, wherein some regions of the area are substantially disjoint regions of visual perception.

28. The efficient lighting system of claim 26, wherein each subset of the lighting elements corresponds to a substantially constant load.

29. The efficient lighting system of claim 26, wherein the second time interval has a different duration from the first time interval.

30. The apparatus of claim 1, wherein the separated regions include separated compartments of a space.

31. The apparatus of claim 1, wherein the separated regions include upper and lower cabinets of a show-case.

32. The apparatus of claim 1, wherein the separated regions include different rooms.

* * * * *